US007201283B2

(12) United States Patent
Matuszewski

(10) Patent No.: US 7,201,283 B2
(45) Date of Patent: Apr. 10, 2007

(54) PLASTIC BAG CADDY

(76) Inventor: Craig B. Matuszewski, 6510 Woodridge Dr., Woodridge, IL (US) 60517

( * ) Notice: Subject to any disclaimer, the term of this patent is extended or adjusted under 35 U.S.C. 154(b) by 283 days.

(21) Appl. No.: 10/922,864

(22) Filed: Aug. 23, 2004

(65) Prior Publication Data

US 2006/0037922 A1 Feb. 23, 2006

(51) Int. Cl.
*A47G 29/00* (2006.01)

(52) U.S. Cl. ..... 211/85.15

(58) Field of Classification Search ..... 211/85.15; 248/95

See application file for complete search history.

(56) References Cited

U.S. PATENT DOCUMENTS 4,886,173 A * 12/1989 Goulter ..... 211/89.01
5,285,927 A * 2/1994 Pruitt ..... 221/22
5,341,933 A * 8/1994 Willows ..... 206/554
5,451,108 A * 9/1995 Anderson ..... 383/38
5,884,878 A * 3/1999 Eckhardt ..... 248/95
6,006,801 A * 12/1999 Litwak et al. ..... 141/316
6,012,843 A * 1/2000 Brooks et al. ..... 383/37

* cited by examiner

*Primary Examiner*—Sarah Purol
(74) *Attorney, Agent, or Firm*—Gregory B. Beggs

(57) ABSTRACT

A rack, or caddy, is disclosed which stores and dispenses used plastic bags. Normally the bags are grocery store or department store sized bags made from a thin film of plastic which have been saved for reuse somehow. The caddy includes a sheet member which may be made of molded plastic material such as polypropylene, and it has several cups joined to it. The interior walls of the cups are spaced far enough apart to permit a user to insert hand compacted plastic bags into the cups, and thereafter the walls hold them there by limiting the expansion of the bags.

9 Claims, 4 Drawing Sheets

PLASTIC BAG CADDY

BACKGROUND OF THE INVENTION

The present invention relates to racks for storing and dispensing thin film plastic bags, such as used grocery bags which have been saved for some future use after the groceries have been removed. More particularly, it relates to a caddy for holding and retaining the bags after they have been compacted by hand, such as by crushing, folding or twisting.

It is safe to say that the vast majority of more than 292 million people in the United States save plastic grocery store, specialty store or department store bags. But for many people, the hundreds of millions of saved plastic bags, although useful at times, have proven to be a source of clutter and frustration.

Various storage solutions have been brought forward. One, which is illustrated in U.S. Pat. No. 6,012,843, issued Jan. 11, 2000, provides a cloth bag or tube with an open top and open reduced diameter bottom into which the plastic bags, of all sizes, are indiscriminately stuffed. The bag is hung by a loop in a cord fastened around the upper end of the bag and engaged on a hook.

A similar solution is illustrated in U.S. Pat. No. 5,341,933, issued Aug. 30, 1994. In that patent a cloth tube is provided with a wide entry opening at its upper end and a drawstring for pulling the upper end of the bag closed. The drawstring also forms a loop to use in hanging the bag up. An elastic band is sewn in a hem around the open lower end of the bag to reduce the diameter or that opening.

A modified fabric sack type of storage container is shown in U.S. Pat. No. 5,451,108, issued Sep. 19, 1995. That patent recognizes the need for sorting bags of different sizes from each other. The larger bags are crushed and stuffed into the top of a fabric tube, much like the "933 patent unit, but the inventor in '108 has provided a separate pocket or set of pockets for different sizes of bags also. The separate pockets are sewn onto the outside of the main fabric tube and are themselves provided with elasticized upper input and lower outlet ends outside of the main tube.

Still another form of container is illustrated in U.S. Pat. No. 5,285,927. That form includes a relatively rigid upper can into which crushed plastic bags may be dropped and weighted down by a lid placed over them. The lid is slidably disposed in the can so that it rests upon and follows the upper surface of the crushed plastic bags inside the can. A flexible sleeve hangs from the upper can and receives a supply of the crushed plastic bags. The upper end of the sleeve portion matches the size of the open lower end of the can, and the lower end of the sleeve narrows to a small lower opening which allows only a single one of the crushed plastic bags to be withdrawn.

These constructions demonstrate that there is a need for a container which is easy to access, which will hold the plastic bags for reuse, and which accommodates sorting them by size.

SUMMARY OF THE INVENTION

The present invention is embodied in a plastic bag caddy which includes a sheet member with a plurality of cups joined to it. Each cup has interior walls which are spaced apart from each other a sufficient distance to form engagement surfaces which limit the expansion of hand compacted plastic film bags that a user has disposed within the cup.

From the forgoing, and from what follows, it will be apparent that the present invention solves the prior problems of quickly storing and then retrieving selected sizes of plastic bags.

Accordingly, it is one of the objects of this invention to provide a variety of sizes of readily accessible storage compartments for hand-compacted plastic film bags such as grocery bags which have been previously used for other purposes.

It is another object of this invention to provide a caddy for holding hand-compacted plastic film bags which have been previously used in compartments with walls which intercept the bags as they start to expand after having been compacted.

It is another object of this invention to provide a caddy for holding hand-compacted previously used plastic bags in tubular cups which contain the bags loosely but securely and may be disposed vertically so as to permit withdrawal of selected sizes of the bags at eye level.

It is another object of this invention to provide a storage caddy for plastic bags which have been previously used for other purposes and which accommodates bags prepared for storage by indiscriminate hand crushing, by hand twisting and coiling, or by folding in zig-zagged layers for storage.

Other objects and features of this invention will be apparent to those skilled in the art of designing, constructing and using storage racks for keeping and dispensing plastic grocery bags, or similar consumer product bags which have been saved by a householder for future reuse, from an examination of the following detailed description of preferred embodiments of the invention and an examination of the accompanying drawings.

DESCRIPTION OF THE PREFERRED EMBODIMENTS

The preferred embodiments of this invention shown in the accompanying drawings will now be described, it being understood that the preferred forms are illustrative and that the invention described herein is embodied in the claims appended to this description.

Figure 1:
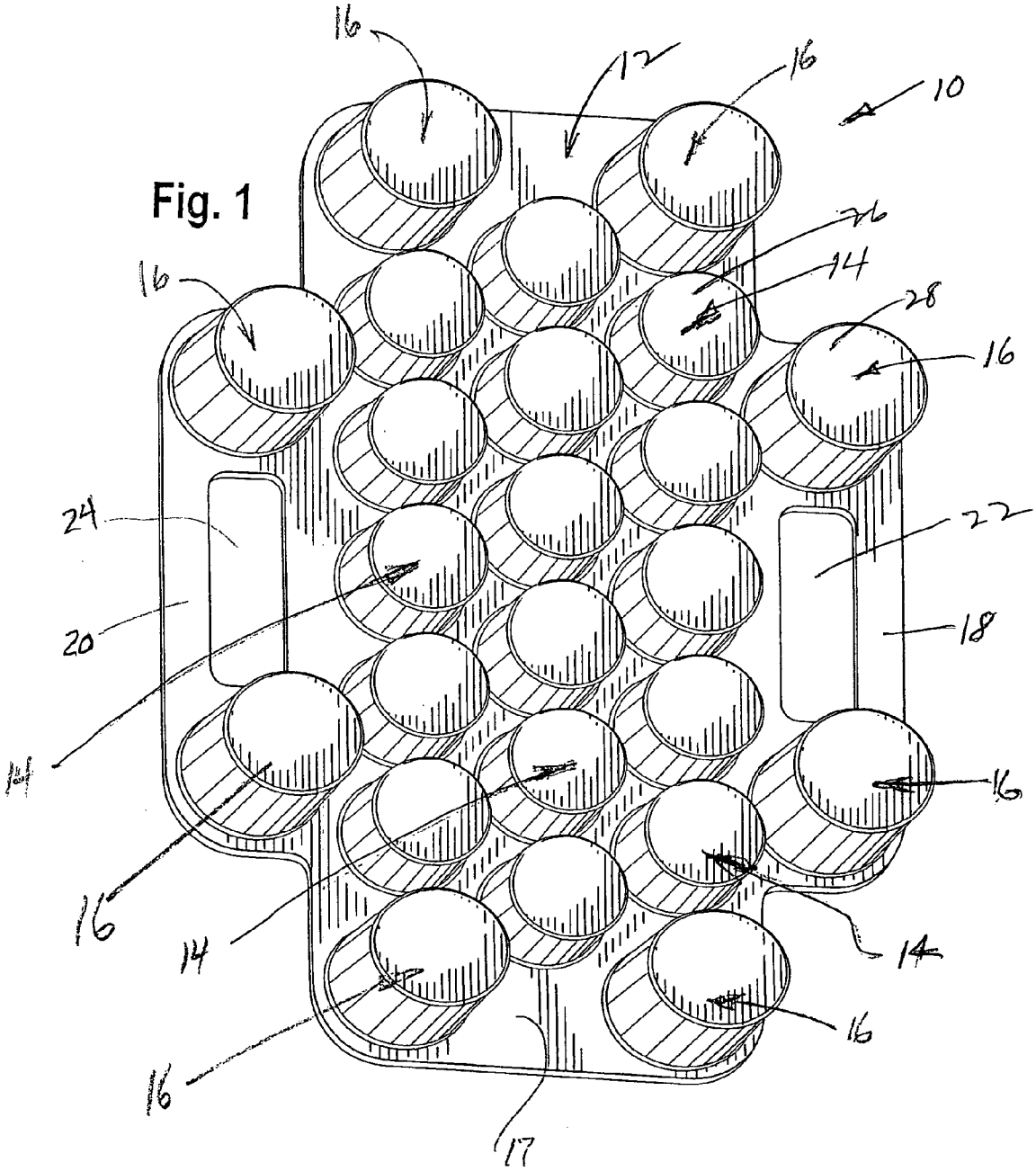
FIG. 1 is a perspective view of the bottom of a caddy embodying the present invention.

The caddy 10 shown in FIG. 1 includes a sheet member 12 which preferably is made from a moldable lightweight material such as a polypropylene plastic. A plurality of cups 14, which may be all approximately the same size but preferably include a larger size 16, is joined to the bottom side 17 of the sheet 12. When viewed from the bottom side 17 of the sheet, as shown in FIG. 1, cups 14 and 16 may be arranged with the larger cups 16 disposed along the outer extremities of sheet 12 and the smaller cups 14 disposed more toward the middle of sheet 12 (See FIG. 3, also). In the preferred form of the caddy 10, opposite edge portions 18 and 20 of sheet 12 are formed with apertures 22 and 24 creating handles along the edges of the sheet at 18 and 20. The sheet 12 may be conveniently dimensioned as about 16¾ inches long and about 11¾ inches wide, with the apertures for the handles located at approximately the mid-points of the longer sides.

Preferably, too, the cups 14 and 16 include web portions, such as 26 and 28, substantially closing the bottom ends of the cups. The plastic bags stored in the cups may be stuffed hastily into the cups by a user, and unless there is a limiting member such as the web portions 26 and 28, bags pushed to the bottom ends of the cups may be partially pushed through the cups and become engaged on the outside edges of the sides of the cups, thus making withdrawal difficult and perhaps snagging the bags.

Figure 2:
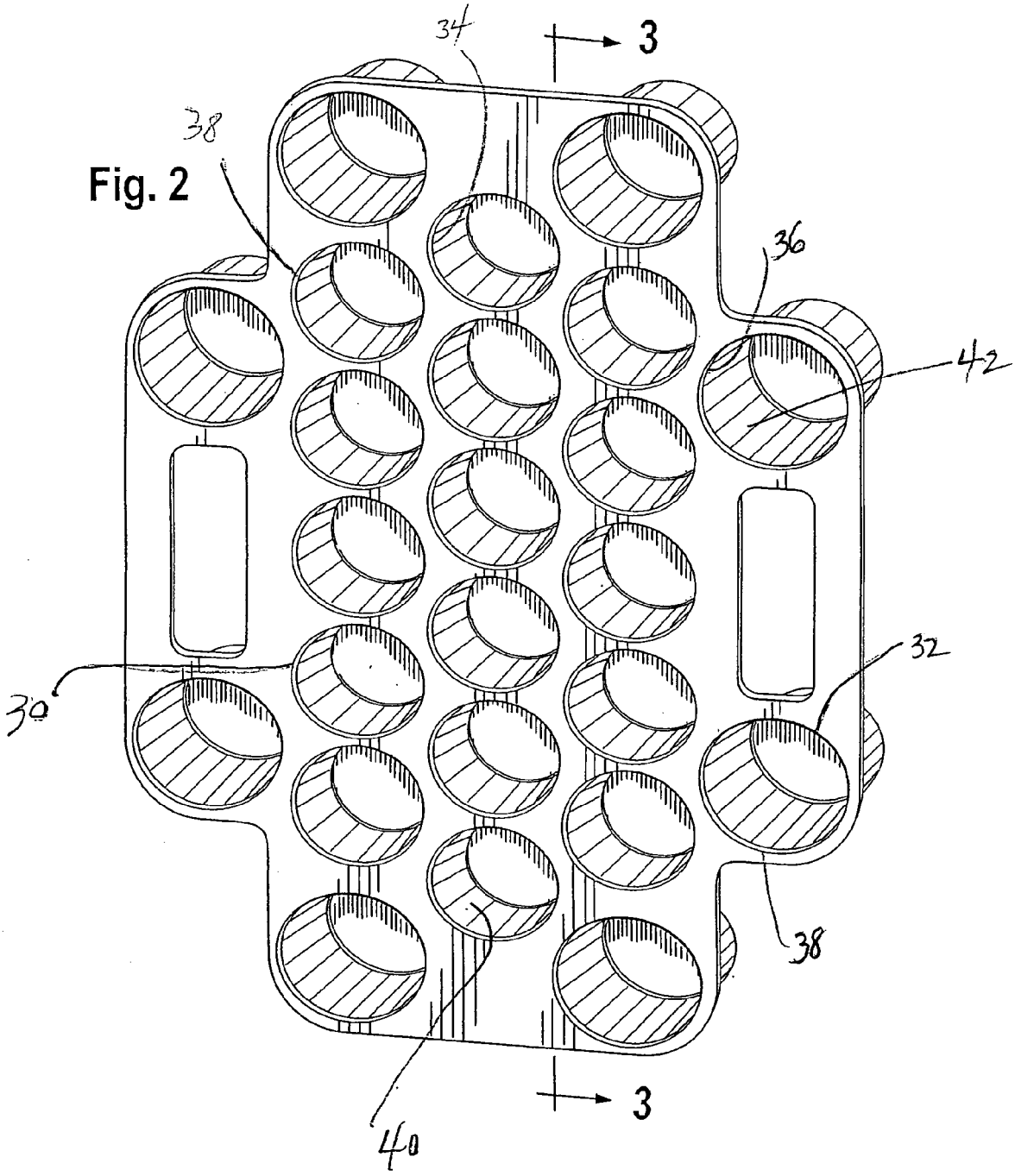
FIG. 2 is a perspective view of the top of the caddy in FIG. 1.

It may be desirable to provide a variety of diameters in the cups for storing different sizes of bags. In the preferred form of the caddy 10, the short cups 14 have a smaller diameter than the cups 16 have. It has been found that one suitable inner diameter for the short cups 14 is 1¾ inches, and that a suitable diameter for the larger cups 16 is 2 inches. Sheet 12 may be provided with a plurality of apertures (See FIG. 2), such as those at 30 and 32, to accommodate the variety of diameters of the cups, i.e., the shorter diameters of cups 14 and the longer diameters of cups 16. The open ends 34 and 36 of the short and long cups 14 and 16, respectively, are joined to sheet 12 adjacent to the apertures 30 and 32, normally with a conically shaped collar 38 at the junction of each cup to the sheet member that unites the cups with the planar body of sheet 12.

Alternatively, instead of forming the cups separately and then joining them to the sheet, it may be preferable to form the entire caddy as a unit, as in a mold.

It is also preferable to form the cups 14 and 16 with circular inner walls 40 and 42 due to the fact that curved walls are more economical to make in a mold. However, as shown in the alternative embodiment 44 of caddy 10 in FIG. 8, the cups 14 and 16 may be formed as small cells 46 and larger cells 48 having flat planar walls 50 and 52 angularly disposed to each other in small cells 46, and walls 54 and 56 similarly angularly disposed to each other in the larger cells 48. The cells may be hexagonal in cross section, as shown, or may be formed with rectangular cross sections or other geometric configurations.

Whatever cross section is adopted, the inner walls are arranged with diameters which restrain the expansion of plastic bags which have been compacted prior to placing them in the cups. Taking cups 14 and 16 for example, larger plastic bags may be stored in cups 16, and smaller bags in cups 14. The bags may be compacted in various ways, which will shortly be described, and they are held gently in place by the elastic expansion of the plastic bag material against the inner walls of the cups. Utilizing a variety of cup diameters makes it possible to store a variety of bags, and the open tops of the cups, which are easy to see an easy to reach into, facilitate a user's selection of a proper bag size for a prospective job.

Figure 3:
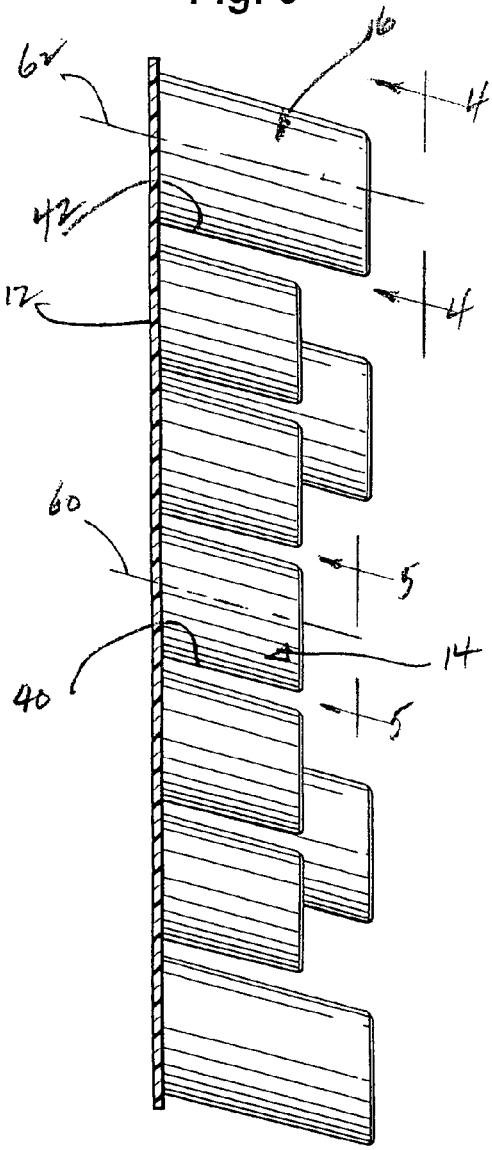
FIG. 3 is a sectional view of the caddy in FIG. 2, taken along the line 3—3 in FIG. 2.
Figure 4:
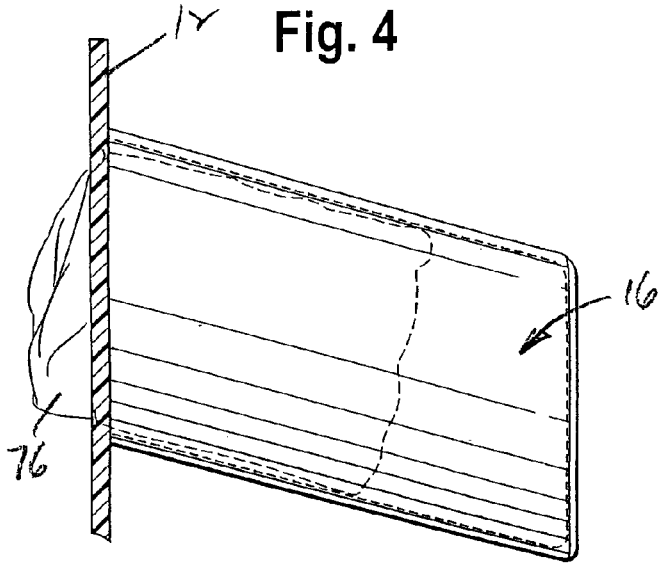
FIG. 4 is an enlarged fragmentary view of a cup portion of the caddy shown in FIG. 3 taken in the direction of arrows 4—4 in FIG. 3.
Figure 5:
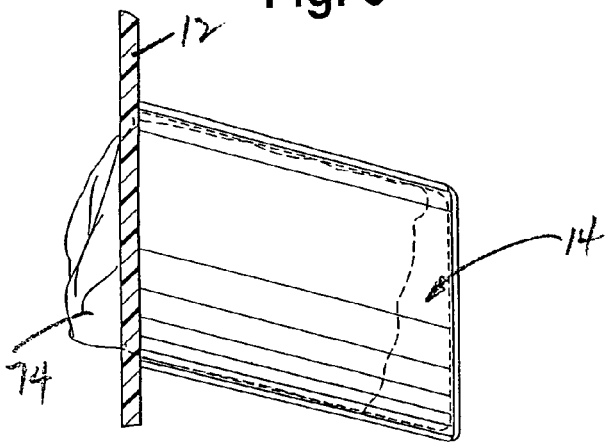
FIG. 5 is an enlarged fragmentary view of a second cup portion of the caddy shown in FIG. 3 taken in the direction of arrows 5—5 in FIG. 3.

The caddy 10 may be used by placing it horizontally, as on a shelf, that is, so that the sheet member 12 is in a horizontal plane, or it may be placed vertically on a wall or door. See FIG. 3, for example, in which the sheet member 12 is arranged vertically. The vertical position is also illustrated for the alternative embodiments 44 and 58 in FIGS. 6 and 8. Preferably, as shown in FIGS. 3 through 5, when it is contemplated that the caddy 10 will be disposed vertically, the central axes 60 and 62 of cups 14 and 16 will be formed at an acute angle to the general plane of sheet 12. It has been found that one such angular disposition of the axes 60 and 62 is about 75 degrees to the plane of sheet 12. When the caddy 10 is being used on the inside of a pantry door, for example, which is frequently swung open in a forceful manner, the upward slope of the cup's inner walls 40 and 42 will help keep the bags inside the cups.

Hanging the caddy 10 in a vertical position may be accomplished in a number of ways. One method, shown in FIGS. 6 and 7 with respect to alternative embodiment 58, is to form holes 64 in the web portions of two or more of the larger cups 16A and put screws 66 through them. The screws 66 may be fastened into a door 68 or other vertically arranged supporting member.

Figure 8:
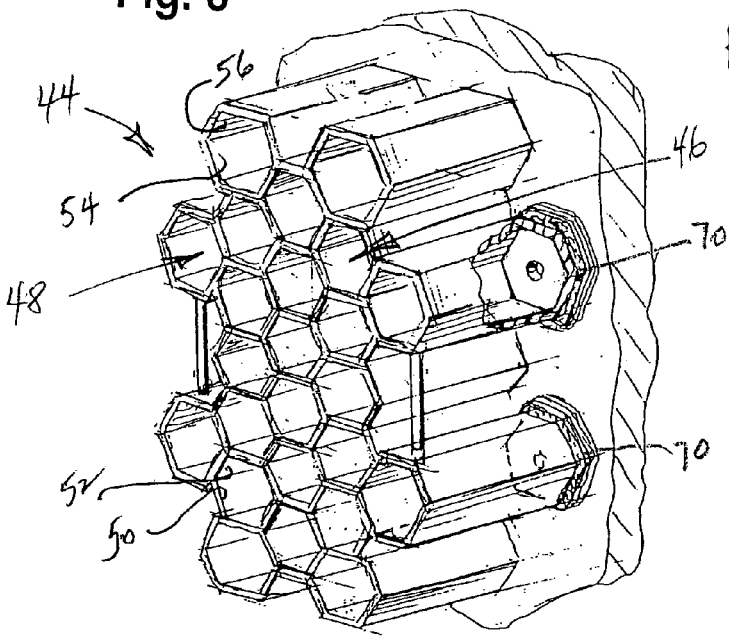
FIG. 8 is a perspective view of a further alternative form of the caddy shown in FIG. 1, partly broken away and mounted on a vertical surface.

Alternatively, as shown in FIG. 8, Velcro fastening members 70 may be used between the cells 48 and a vertical support 72. Particularly when caddies 44, 10 or 58 are made of polypropylene or similar lightweight material, they can be vertically supported easily by hanging them with an adhesive member such as a Velcro hook and loop mounting.

Figure 6:
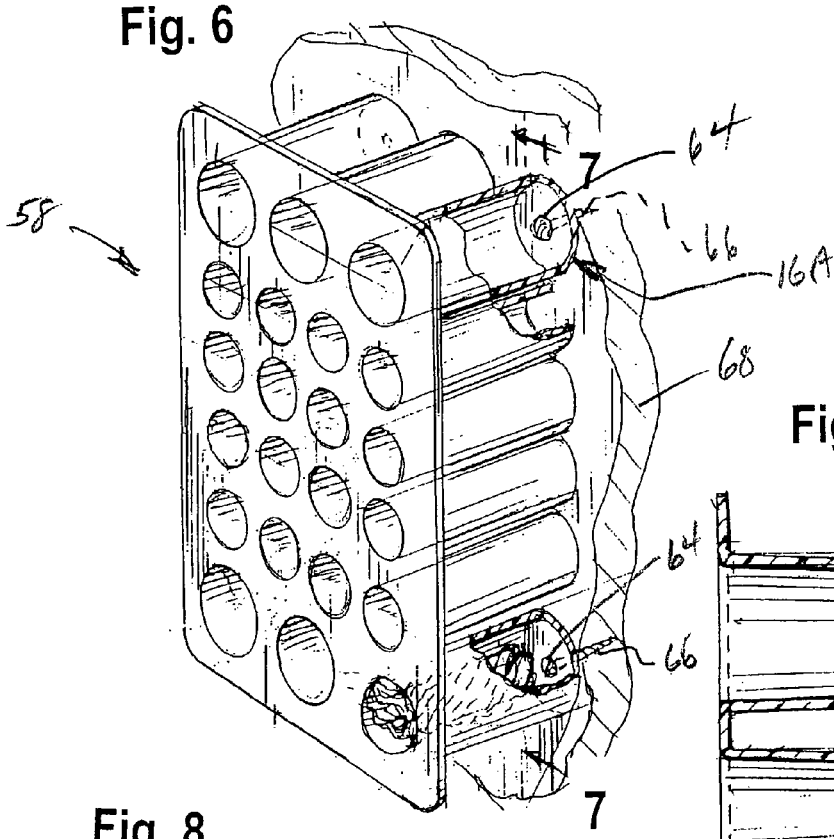
FIG. 6 is a perspective view of an alternative form of the caddy shown in FIG. 1, partly broken away and mounted on a vertical surface.
Figure 7:
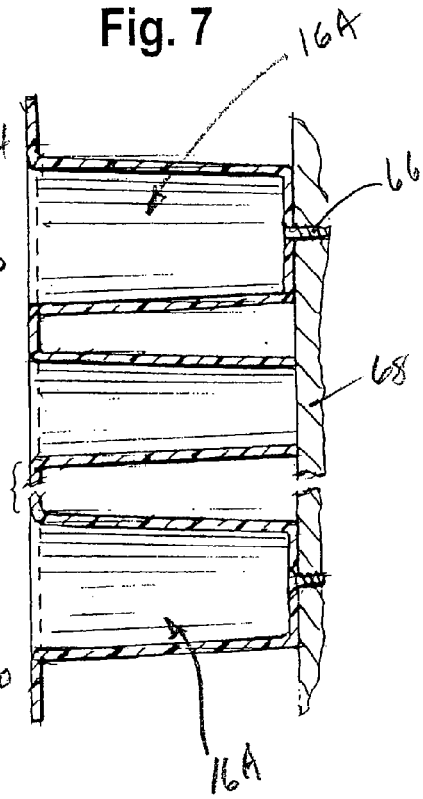
FIG. 7 is an enlarged view of a portion of the caddy shown in FIG. 6 taken along the line 7—7 in FIG. 6.

The caddy embodiment 58 shown in FIGS. 6 and 7 incorporates a conical shape for cups 16A. This shape may be advantageous for users who simply thrust plastic bags at the caddy. The cups 16A are still deep enough, and have a narrow enough diameter, so that the bags are retained inside the cups by limiting their expansion after they have been placed within the cups. Somewhat similarly, the hexagonally shaped cells 46 and 48 in the embodiment of this invention shown in FIG. 8 have a narrow enough nominal diameter to retain the bags by limiting their expansion. In each embodiment the bags are arranged easily by size in larger and smaller cups, making it possible for a user to choose a desirable size of bag quickly, and in each embodiment allowing him to easily take out the size of bag that he needs.

Compacting the bags to insert them into the cups may be done in a variety of ways. After they are inserted, different sizes of bags are held in place, as illustrated in FIGS, 4 and 5, until a user desires to withdraw them, i.e., smaller bags, such as bag 74, can be stored and held in the smaller diameter, shorter cups 14, and larger bags, such as bag 76, can be stored and held in the larger diameter, longer cups 16.

One method of compacting a plastic bag, which takes only a few seconds, is to grasp one corner of the bag between the thumb and index finger of one hand, place the other index finger in the loop handle of the bag, pull the bag taut to form a plastic bag "rope," let go of the handle with the second hand and squeeze the air out of the bag with the second hand by dragging the length of the bag with thumb and index finger, grasp the bag near the held, first corner and twist the "rope" formation of the bag around the fingers holding the corner into a rosette, hold the rosette to keep it from unraveling, and insert the rosette into a cup while scraping it off of the finger holding it.

A second method of compacting a plastic bag, which takes only a few seconds longer, is to stretch the bag on a flat surface from a bottom corner to the loop handle, fold the bag into a strip and smooth the air out of it, fold the strip in sections from the bottom to the loop handle, form a rosette around a finger from the folded length of the bag and scrape the rosette into a cup.

A third method, similar to the second but more deliberate and consuming less final space in the cup, is to fold the bag into a bellows after a strip has been formed and the air ironed out. The bellows can then be shaped into a rosette, as above described, and the rosette scraped into a cup.

Other methods will undoubtedly occur to the millions of people who save and store plastic bags for future use. The three methods described above provide for several bags to be stored in the cups of the caddy of this invention. Whatever the method of compaction which is adopted may be, the caddy described above retains the bags as they tend to unfold and expand within the cups.

It is evident from the preceding disclosure that even though particular forms of the invention have been illustrated and described, still various modifications can be made without departing from the true spirit and scope of the invention. No limitations on the invention are intended, and its true scope is set forth in the following claims.

I claim:

1. A plastic bag caddy comprising a sheet member and a plurality of cups joined to the sheet member, each of the cups including a closed end spaced apart from the sheet member, and each cup having interior walls spaced apart from each other a sufficient distance to form engagement surfaces limiting the expansion of hand compacted plastic film bags disposed within the cup.

2. The bag caddy of claim 1 in which the sheet member includes a plurality of apertures and each cup includes an open end joined to the sheet member at an aperture.

3. The bag caddy of claim 2 in which the sheet member includes a conically shaped collar section adjacent the junction of each cup with the sheet member.

4. The bag caddy of claim 1 in which fastening members are disposed through at least a pair of the closed ends of the cups and join the caddy to a vertical surface.

5. The bag caddy of claim 1 in which each of the cups includes a plurality of planar walls angularly disposed to each other.

6. The bag caddy of claim 1 in which each of the cups includes circular walls.

7. The bag caddy of claim 1 in which the sheet member defines a substantially flat plane and each of the cups includes a longitudinal central axis disposed at an acute angle to the flat plane.

8. The bag caddy of claim 2 in which a variety of diameters of open ends of the cups are joined to the sheet member.

9. A plastic bag caddy comprising a sheet member and a plurality of cups joined to the sheet member, each cup having interior walls spaced apart from each other a sufficient distance to form engagement surfaces limiting expansion of hand compacted plastic film bags disposed within the cup.

* * * * *